US009035210B1

(12) United States Patent
Davis

(10) Patent No.: US 9,035,210 B1
(45) Date of Patent: May 19, 2015

(54) OPTICAL ROBOTIC SORTING METHOD AND APPARATUS

(75) Inventor: Curt Matthew Davis, AnKeny, IA (US)

(73) Assignee: Bratney Companies, Des Moines, IA (US)

( * ) Notice: Subject to any disclaimer, the term of this patent is extended or adjusted under 35 U.S.C. 154(b) by 646 days.

(21) Appl. No.: 13/209,181

(22) Filed: Aug. 12, 2011

Related U.S. Application Data

(60) Provisional application No. 61/374,526, filed on Aug. 17, 2010.

(51) Int. Cl.
*B07C 5/342* (2006.01)

(52) U.S. Cl.
CPC ..... *B07C 5/342* (2013.01); *Y10S 209/938* (2013.01)

(58) Field of Classification Search
USPC ..... 209/577, 581, 588, 539, 938; 53/53, 53/240.1
See application file for complete search history.

(56) References Cited

U.S. PATENT DOCUMENTS

| | | | | |
|---|---|---|---|---|
| 3,612,274 | A | 10/1971 | Schmidt | |
| 3,880,289 | A | 4/1975 | Gray | |
| 4,379,510 | A | 4/1983 | Ziegel | |
| 4,436,207 | A | 3/1984 | Klukis | |
| 5,017,003 | A | 5/1991 | Keromnes | |
| 5,238,121 | A | 8/1993 | Frisbie | |
| 5,290,134 | A | 3/1994 | Baba | |
| 5,842,272 | A | 12/1998 | Nuxoll | |
| 6,213,708 | B1 | 4/2001 | Allen | |
| 6,282,308 | B1 * | 8/2001 | Cossette | 382/137 |
| 6,433,293 | B1 | 8/2002 | Bollinger | |
| 6,502,877 | B2 | 1/2003 | Schick | |
| 7,309,204 | B2 | 12/2007 | Dorner | |
| 7,735,302 | B2 | 6/2010 | Monti | |
| 7,765,025 | B2 | 7/2010 | Wynblatt | |
| 7,773,214 | B2 | 8/2010 | Sones | |
| 8,225,939 | B2 * | 7/2012 | Nelson et al. | 209/538 |
| 8,373,081 | B2 * | 2/2013 | Ackley et al. | 209/580 |
| 2002/0104291 | A1 | 8/2002 | Kondou | |
| 2003/0006170 | A1 * | 1/2003 | Lawandy | 209/3.3 |

FOREIGN PATENT DOCUMENTS

| | | | |
|---|---|---|---|
| WO | 0277608 | A2 | 3/2002 |
| WO | 2006042543 | A1 | 4/2006 |

* cited by examiner

*Primary Examiner* — Terrell Matthews
(74) *Attorney, Agent, or Firm* — Brick Gentry PC; Brian J. Laurenzo; Jessica L. Susie

(57) ABSTRACT

An optical robotic sorting method and apparatus for identifying and sorting a product is provided. In the preferred embodiment, the method comprises the steps of illuminating the product with a light source, imaging the product using at least one imaging device, analyzing the image, and activating a robotic sorter to sort the product.

6 Claims, 6 Drawing Sheets

OPTICAL ROBOTIC SORTING METHOD AND APPARATUS

CROSS-REFERENCE TO RELATED APPLICATIONS

This application claims the benefit of U.S. Provisional Application No. 61/374,526, filed Aug. 17, 2010.

FIELD OF THE INVENTION

The present invention relates to an optical robotic sorting method and apparatus. More specifically, the present invention relates to an optical robotic sorting method and apparatus for sorting a product, such as ears of corn, on a conveyor.

BACKGROUND

A little over fifty years ago picking, husking and sorting ears of corn would be done two or three rows at a time by a person in the field wearing a corn husking hook. Today ears of corn are usually mechanically harvested by a corn picker and maybe delivered to a corn husking unit to be husked. Corn husking units usually process a large number of ears of corn and often fail to completely remove the husk off of every ear of corn. After the ears of corn have been processed by the corn husking unit, the ears of corn must then be reviewed for flaws and sorted.

Ears of corn that still have a full husk, are partially husked, diseased, or rogue are considered defective and must be properly sorted and/or removed from the production stream. The sorting of the ears of corn has almost been exclusively done on a conveyor by human hands. Unfortunately, using human labor to sort the ears of corn has several drawbacks. Typically, the ears of corn are moving quickly along the conveyor so there is a need for multiple people sorting on each conveyor to accurately sort the ears of corn. In addition, people need to take breaks, occasionally get sick, and are unable to consistently repeat a process the same way every time. Furthermore, using human labor can have a high turnover rate and new employees must be trained. Therefore, the costs associated with sorting ears of corn may be reduced by automating the sorting process. There would be significant advantages of using an automated system instead of human labor.

There have been attempts to automate the process of sorting corn but none have been capable of effectively replacing a human. To effectively automate the corn sorting process, the automated corn sorter has to be able to identify the defective corn and be able to sort the defective corn into multiple sorting areas. The unhusked and partially husked corn must be returned to the husking unit, while the diseased and rogue corn must be removed from the process.

SUMMARY OF THE INVENTION

This Summary is provided to introduce a selection of concepts in a simplified form that is further described below in the Detailed Description. This Summary is not intended to identify key aspects or essential aspects of the claimed subject matter. Moreover, this Summary is not intended for use as an aid in determining the scope of the claimed subject matter.

A method of identifying and sorting a product on a conveyor is provided comprising the steps of illuminating the product with a light source, imaging the product using at least one imaging device, analyzing the image, and activating a means for sorting the product.

In an embodiment, the method of identifying and sorting defective ears of corn on a conveyor comprises the steps of delivering ear corn to a corn husking unit, husking the ear corn using the corn husking unit, transporting the ear corn from the corn husking unit onto a conveyor, depiling the ear corn, illuminating the ear corn using at least one light source, imaging the ear corn using at least one imaging device, analyzing the image to identify the defective ears of corn, picking the defective ears of corn from the conveyor using at least one robotic sorter, and moving the defective ears of corn with the robotic sorter into at least one area for receiving defective ears of corn.

Additionally, the apparatus for identifying and sorting a product on a conveyor is also provided comprising a light source, an imaging device, a central processing unit in communication with the imaging device, and a means for sorting the product in communication with the central processing unit and the light source.

In an embodiment, the apparatus is an optical robotic sorter for use in sorting defective ears of corn from a conveyor comprising a central processing unit, an imaging device in communication with the central processing unit, a robotic arm in operable communication with the central processing unit and connected to a structural frame, a vacuum tool connected to the robotic arm, a vacuum source operably connected to the vacuum tool, and a means for controlling the optical robotic sorter in communication with the central processing unit.

The above-mentioned method and apparatus solve the problems disclosed in the Background and have numerous advantages over the traditional means of sorting product on a conveyor. Additionally, other features and advantages of the method and apparatus will become more fully apparent and understood with reference to the following Detailed Description, Drawings, and Claims.

BRIEF DESCRIPTION OF THE DRAWINGS

FIG. 3 illustrates the corn husking unit, conveyor, depiler, LED's, imaging device, robotic sorter, encoder, Central Processing Unit (CPU), vacuum source, control panel, and additional conveyors for transferring the sorted corn.

FIG. 4 more clearly shows the corn husker depositing corn on the conveyor, the corn moving under the depiler, the LED illuminating the ears of corn, the camera capturing images of the ears of corn, the robotic sorter, the encoder, the CPU, and the control panel.

FIG. 5 illustrates the housing, robotic arm, and the end-of-arm tool gripping an ear of corn.

FIG. 6 illustrates the silicon vacuum cup gripping an ear of corn.

DETAILED DESCRIPTION

The following provides one or more examples of embodiments of an optical robotic sorting method and apparatus. For ease of discussion and understanding, the optical robotic sorter 100 is illustrated in association with a corn husking unit 110 and conveyors 120, 122, 124, 126, and 128. It should be appreciated that the corn husking unit 110 and conveyors 120, 122, 124, 126, and 128 may be any type, style, or arrangement of corn husking units or conveyors. Furthermore, the corn husking unit 110 and conveyors 120, 122, 124, 126, 128 may be any currently known or a future developed corn husking unit or conveyor for which it would be advantageous to use with one or more examples or embodiments of the optical robotic sorting method and apparatus.

Figure 1:
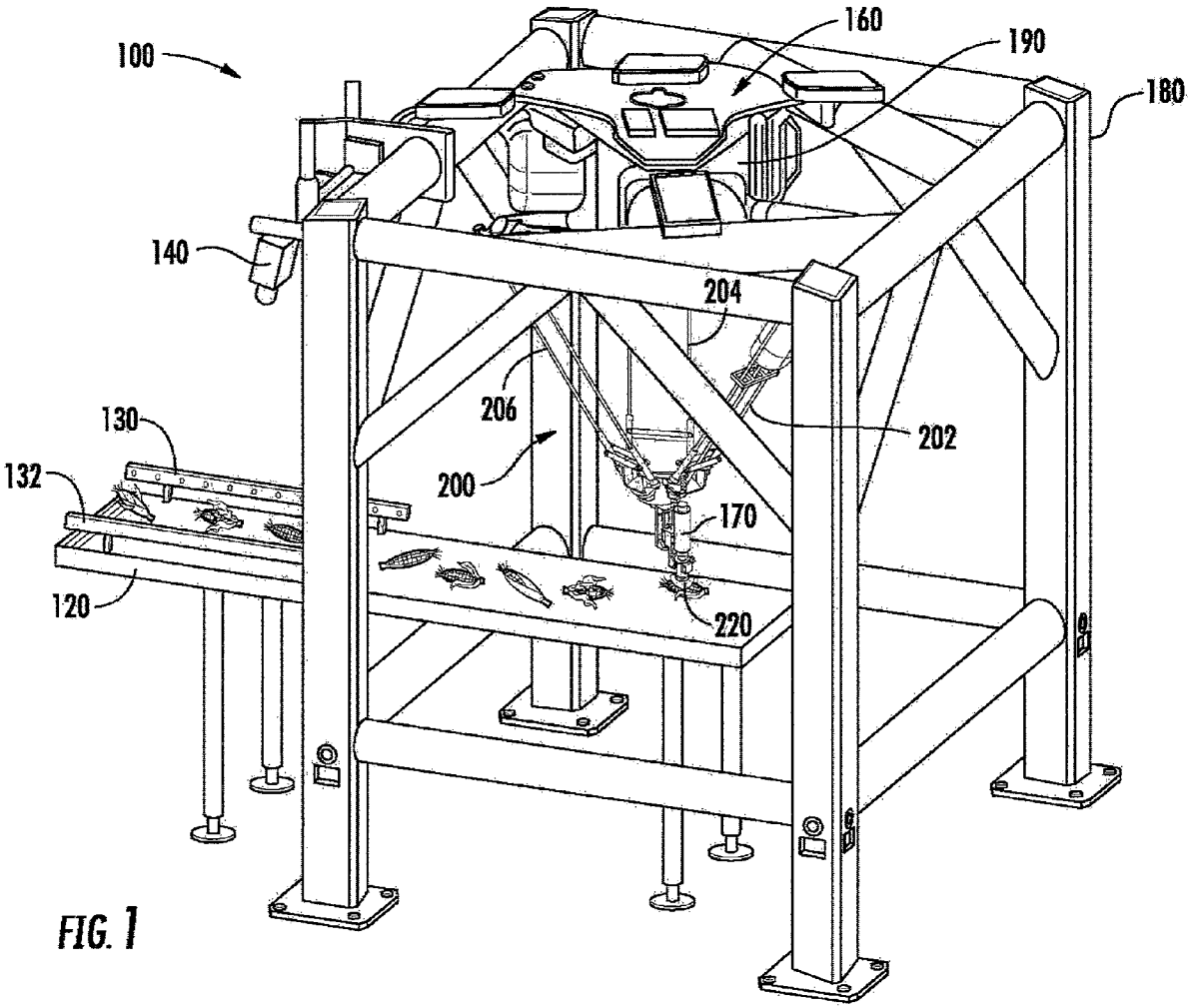
FIG. 1 is a perspective view of the optical robotic sorter, illustrating a Light Emitting Diode (LED) illuminating product on a conveyor as it passes under a camera, which captures images of the product, and the robotic arm removing product from the conveyor.

FIG. 1 illustrates the process of sorting product, such as corn, from a conveyor 120 using an optical robotic sorter 100. As the product travels along the conveyor 120 a light source illuminates the product. The light source in the preferred embodiment is at least one Light Emitting Diode (LED), although two LEDs 130, 132 are shown in the drawings, which may emit specific colors of light that better illuminate the product on the conveyor 120. It is anticipated that any light source may work, including ambient light, depending on the quality of the imaging device and the product that is illuminated. Additionally, it is anticipated that more than one light source may be used to illuminate the product. Furthermore, it is anticipated that the light may be of any frequency including, but not limited to, infrared, visible, and ultraviolet.

Figure 2:
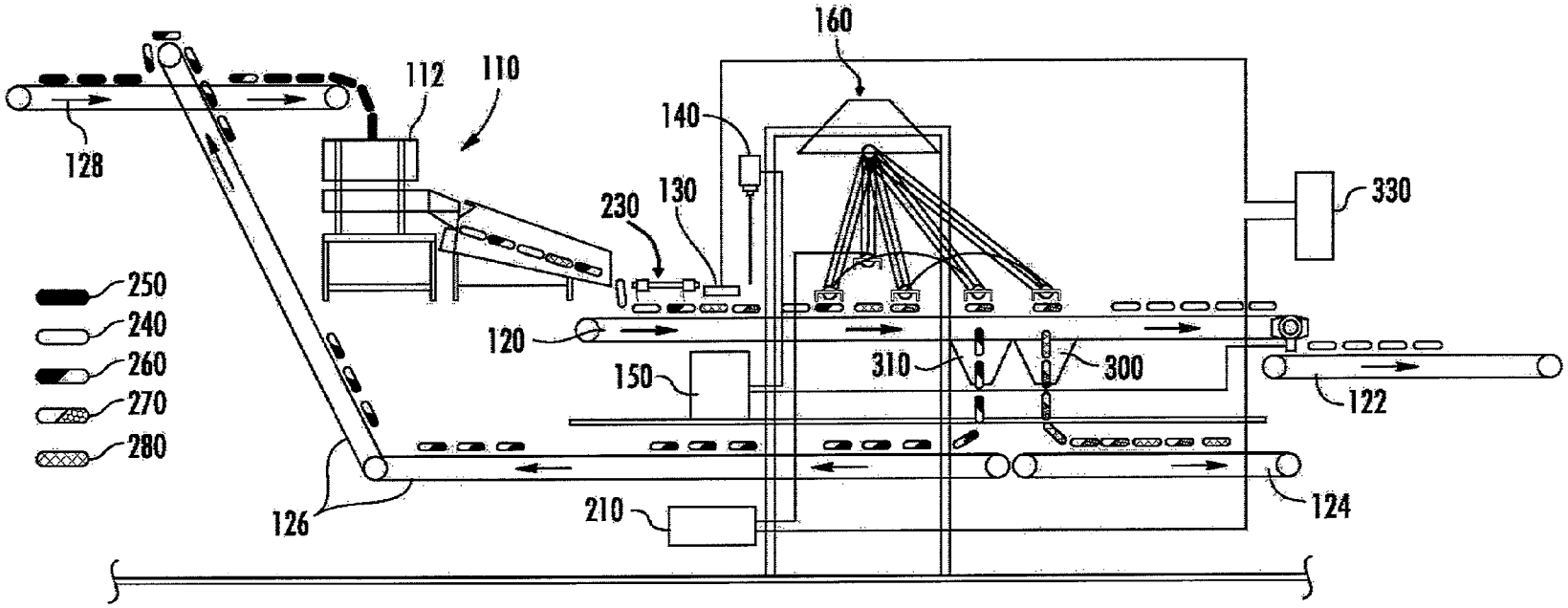
FIG. 2 is a flow diagram illustrating the process of sorting corn on a conveyor. Ear corn is delivered to a corn husking unit, husked, and then deposited on the conveyor. Unhusked, partially husked, diseased, and rogue ears of corn are removed from the conveyor and sorted. The unhusked and partially husked ears of corn are returned to the corn husking unit.
Figure 3:
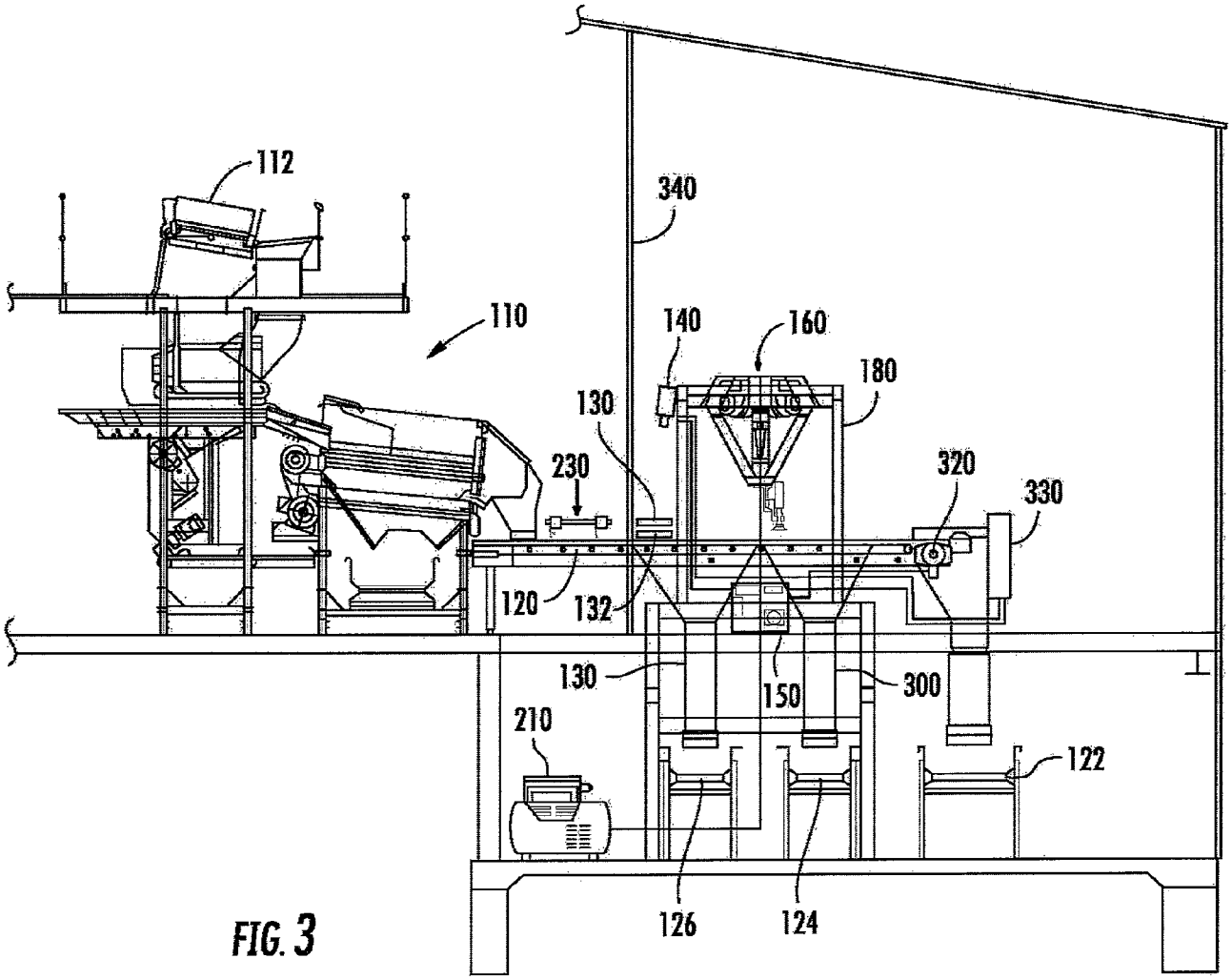
FIG. 3 is a side cut away view of a sorting area containing the machinery used to process the corn.
Figure 4:
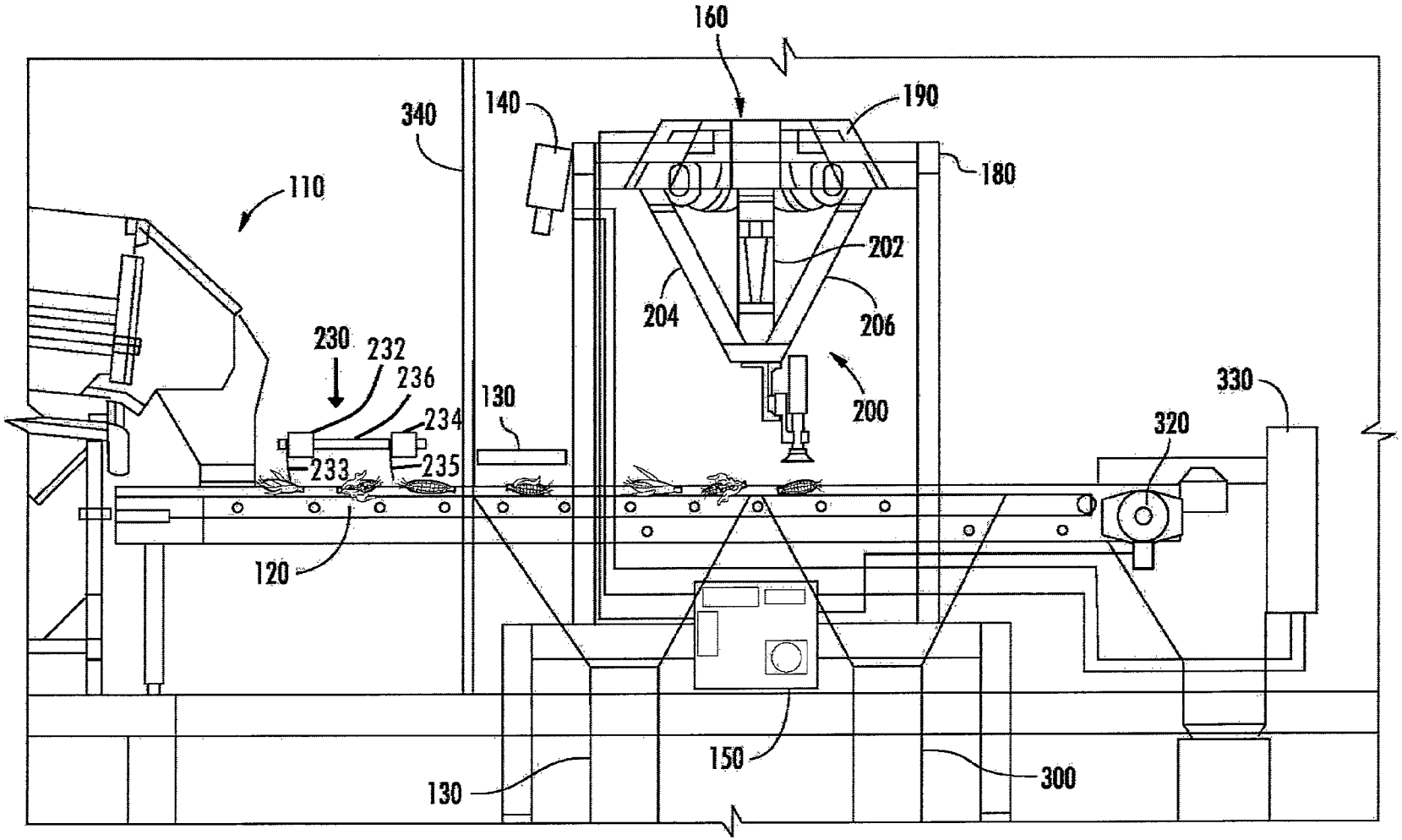
FIG. 4 is an enlarged side cut away view of the sorting area containing the machinery used to process the ears of corn.

After the product has been illuminated, an imaging device 140 captures an image of the product and communicates that image to the Central Processing Unit (CPU) 150 (shown in FIGS. 2, 3 and 4). The imaging device 140 in the preferred embodiment may be any available device suitable for capturing the image of the product. Currently, some specific cameras that accomplish acceptable imaging include, but are not limited to, Cognex, Resonon Pika II Hyperspectral Imager, and Sony XC-56 Progressive Scan Camera with lens filter and camera enclosure to improve application reliability. The image captured may be a color image or any type of image useful in identifying the defective product. It is anticipated that any imaging device 140 suitable for capturing the image of the product may be used. Furthermore, it is anticipated that future developed methods or apparatus may be used to capture the image of the product.

The image of the product is then analyzed by a software program which determines if the product should be removed from the conveyor 120 and sorted. If the program determines that the product should be removed from the conveyor 120 then a signal is sent to the robotic sorter 160 to remove the product from the conveyor 120 and place the product in the proper area. The software currently used in the preferred embodiment is R-30iA iRVision eDoc. The current software program identifies variations in color and texture to determine if the product is defective. It is anticipated that changes or updates to the software may be made and that the software may be used to analyze different aspects of different product in different ways. Furthermore, it is anticipated that any software currently known or developed in the future that is capable of analyzing the images and/or operating the optical robotic sorter 100 may be used.

The robotic sorter 160, of the optical robotic sorter 100, is an automated means of sorting the product from the conveyor. In the preferred embodiment, the robotic sorter 160 is a Fanuc M-3iA 4 Axis Food Grade Robot which has an added end-of-arm tool 170, which may also be referred to as the vacuum tool 170. The robotic sorter 160 is inverted and attached to a structural frame 180 for support and protection. The robotic sorter 160 may be attached to the structural frame 180 by any suitable means and in any configuration capable of properly supporting the robotic sorter 160. In the preferred embodiment, the servo housing 190 of the robotic sorter 160 is attached to the structural frame 180. Additionally, the servo housing 190 has three arm members 202, 204 and 206 attached thereto which make up the robotic arm 200. The three arm members 202, 204 and 206 connect to the vacuum tool 170. The vacuum tool 170 is connected to a vacuum source 210 (shown in FIGS. 2 and 3). In the preferred embodiment, the vacuum source 210 is an air compressor and uses compressed air to create a venturi vacuum running through a vacuum cup 220. Alternatively, the vacuum source 210 may be a vacuum pump or any other means of creating the necessary vacuum in the vacuum tool 170.

When the robotic sorter 160 receives a signal to remove the product from the conveyor 120, the robotic arm 200 positions the vacuum cup 220 next to the product and the vacuum cup 220 wraps around the product creating a seal. The robotic arm 200 is then able to pick up the product and position the product away from the conveyor 120. The vacuum is then turned off and the product is released into a new location. In an alternate embodiment, the vacuum source 210 may be used to forcefully disengage the product from the vacuum cup 220. One way the product may be forcefully disengaged is by blowing air on the product as well as shutting off the vacuum.

FIG. 2 is a flow diagram illustrating the process of sorting corn on a conveyor 120. Initially, ear corn is delivered to a corn husking unit 110 and then the corn husking unit 110 removes the husks from the ear corn. The ears of corn are then deposited onto the conveyor 120. The ears of corn are transported to a depiler 230. The depiler 230 ensures that the ears of corn are not stacked on top of each other. After the ears of corn have been depiled, the ears of corn continue to travel along the conveyor 120 and are then illuminated by at least one light source. The light sources illustrated in the figures and used in the preferred embodiment are LEDs 130, 132. The illuminated ears of corn are then imaged by an imaging device 140. In the preferred embodiment, the images are sent to the CPU 150 and analyzed by a software program to identify defective ears of corn from acceptable ears of corn 240. Acceptable ears of corn 240 are adequately husked ears of corn that are healthy and of a normal size. Defective ears of corn are unhusked ears of corn 250, partially husked ears of corn 260, diseased ears of corn 270, and rogue ears of corn 280. A rouge ear of corn 280 is defined as a 25% size difference of a cob of corn from the average size sampling from a field of corn. The percentage of rogue ears of corn is typically not high since it is based off the average from that specific field.

After the images of the ears of corn are analyzed, a signal is sent to at least one robotic sorter 160 to pick the defective ears of corn from the conveyor 120 and move the defective ears of corn into at least one area for receiving defective ears of corn. In the preferred embodiment, She acceptable ears of corn 240 continue along the conveyor 120 to a second conveyor 122 or a chute (shown in FIG. 3) leading to a second conveyor 122 for further processing. The diseased ears of corn 270 and the rogue ears of corn 280 are dropped into a first or discharge chute 300 and onto a third, or discharge, conveyor 124. The diseased ears of corn 270 and the rogue ears of corn 280 are then removed from the process. The unhusked ears of corn 250 and partially husked ears of corn 260 are dropped into a second, or return, chute 310 and returned to the husking unit 110 by the fourth, or return, conveyor 126. The return conveyor 126 may unload the unhusked ears of corn 250 and partially husked ears of corn 260 onto a fifth, or delivery, conveyor 128. The delivery conveyor 128 may be initially used to transport the ear corn from initial delivery to the husking unit hopper 112. Ultimately, the returned ears of corn begin the process again.

FIG. 2 also illustrates some of the connections between the hardware used in the process, such as the encoder 320 and the control panel 330. The encoder 320 measures the speed of the conveyor 120 and communicates with the CPU 150. In the preferred embodiment, the conveyor 120 moves at an approximate speed of one hundred and twenty (120) feet per minute. The conveyor 120 is capable of moving faster and should be able to move at least fifty (50) feet per minute to process the product on the conveyor 120. Additionally, the conveyor 120 may have a variable speed drive (not shown) and the encoder 320 may be used to slow down or speed up the conveyor 120 to assist in the processing and sorting of the product. It is also anticipated that the speed of the conveyor 120 may also be controlled from the control panel 330. In the preferred embodiment, the control panel 330 operator is able to initiate the process, stop the process, reset the process, turn off and on the LEDs 130, 132, and generally control all of the equipment associated with the process. Additionally, the process will automatically stop if a fault is triggered. A fault may be caused by a malfunction in the equipment, damaged equipment, the product or equipment getting jammed or other errors in the processing. When a fault has been triggered the conveyors automatically stop transporting the product and the robotic sorter 160 automatically stops sorting the product. This allows the fault to be identified and fixed. After the fault has been addressed, the process is reset and the transferring and sorting of the product continues.

FIG. 3 is a side cut away view of a sorting area containing the machinery used to process the corn. FIG. 3 illustrates the corn husking unit 110, conveyor 120, depiler 230, LED's 130, 132, imaging device 140, robotic sorter 160, encoder 320, Central Processing Unit (CPU) 150, vacuum source 210, control panel 320, and additional conveyors for transferring the sorted corn. In the preferred embodiment, the corn husking unit 110 is located on the main floor of the building and is any corn husker capable of removing the husk from the ear corn and depositing the husked ears onto a conveyor. Generally, the corn husking unit 110 will be in a row of numerous corn husking units and ear corn will be delivered to multiple corn husking units so that large amounts of ear corn may be processed simultaneously. In the preferred embodiment, there is a sound barrier 340 between the corn husking unit 110 and the robotic sorter 160. After the corn husking unit 110 deposits the husked corn onto the conveyor 120, the ears of corn are depiled by the depiler 230 and then travel past the sound barrier 340. The sound barrier 340 may be made of any material and configured in any orientation suitable for reducing the noise created by the husking unit 110. Generally, the sound barrier 340 is a wall with an opening for the conveyor 120 and the product to pass through.

After passing the sound barrier 340, the ears of corn are illuminated by a light source. In the preferred embodiment, two LEDs 130, 132 are located next to the conveyor 120, one on each side. The imaging device 140 then captures an image of the ears of corn traveling along the conveyor 120. The imaging device 140 is connected to the CPU 150 and sends the captured image to the CPU 150 to be analyzed by a program. The CPU 150 may be any currently known or future developed central processing unit capable of processing the necessary functions associated with this method and apparatus. Additionally, it is anticipated that the CPU 150 may be incorporated into the disclosed equipment or any other equipment. Also, the CPU 150 could be connected through alternate means, such as wirelessly connected. Furthermore, the CPU 150 could be located anywhere as long as it is still able to make the necessary connections and is operable.

The CPU 150 is also connected to the control panel 330, the encoder 320, the vacuum source 210, and the robotic sorter 160. The ears of corn continue to travel along the conveyor 120. If the program detects flawed or defective ears of corn or ears of corn a signal is sent to the robotic sorter 160 to remove and sort the defective ears of corn. In the preferred embodiment, the robotic sorter 160 is sorting at a rate of approximately ninety (90) picks per minute. The robotic sorter 160 is capable of sorting faster and must be able to sort at a rate of at least forty five (45) picks per minute. It is anticipated that the robotic sorter may be of any configuration that would be able to properly remove and sort the product from the conveyor 120. Additionally, in the preferred embodiment, the conveyor 120, LEDs 130, 132, imaging device 140, encoder 320, control panel 330, and robotic sorter 160 are also located on the main floor of the building.

Should the robotic sorter 160 receive a signal to remove an ear of corn from the conveyor 120, the robotic sorter 160 positions the vacuum tool 170 and, with the vacuum source 210 creating a vacuum, picks up the ear of corn and deposits it into an area for receiving defective ears of corn. In the preferred embodiment, the vacuum source is an air compressor. The air compressor forces air through the end-of-arm tool 170 and creates a venturi vacuum. It is anticipated that the vacuum source 210 may be any means of creating a vacuum, including, but not limited to, a vacuum pump. Additionally, the vacuum source 210 may be connected to the end-of-arm tool 170 by any means and may be located in any location where the vacuum source 210 would be operable. In the preferred embodiment, the areas for receiving defective ears of corn are chutes that lead to other conveyors on the floor below the main floor. FIG. 3 illustrates the discharge chute 300, discharge conveyor 124, return chute 310, and return conveyor 126 located on the floor beneath the main floor. Additionally, the vacuum source 210 is illustrated as being located on the floor beneath the main floor as well. The vacuum source 210 may, however, be located anywhere where the vacuum source 210 would be operable, including, but not limited to, the main floor, on the robotic sorter 160, near the control panel 330.

FIG. 4 illustrates an enlarged side cut away view of the sorting area containing the machinery used to process the ears of corn from FIG. 3. FIG. 4 more clearly shows the corn husking unit 110 depositing corn on the conveyor 120, the corn moving under the depiler 230 and through the sound barrier 340, one of the LED's 130 illuminating the ears of corn, the imaging device 140 capturing images of the ears of corn, the robotic sorter 160, the structural frame 180, the discharge chute 300, the return chute 310, the encoder 320, the CPU 150, and the control panel 330. Additionally, the parts of the depiler 230 are identified in FIG. 4. In the preferred embodiment, the depiler 230 comprises two metal bars 232, 234 with connected strips of material 233, 235 hanging down towards the conveyor 120. The two metal bars 232, 234 are connected by at least one metal pole 236. FIGS. 2, 3 and 4 only show a side view of the metal bars 232, 234 and the metal pole 236 connecting the metal bars 232, 234. Additionally, only one strip of material 233, 235 may be seen in FIGS. 2, 3, and 4, connected to each metal bar 232, 234, however, any number of strips of material 233, 235 may be connected to the metal bars 232, 234. In the preferred embodiment, the strips of material 233, 235 stop approximately two inches above the conveyor 120 to prevent stacked ears of corn from continuing along the conveyor 120. The depiler 230 may be made of any material and may be positioned in any configuration that prevents stacked or piled ears of corn from traveling along the conveyor 120 to the imaging device 140. It is anticipated that other means of depiling the ears of corn may be employed or that other embodiments may not need to depile the ears of corn.

Figure 5:
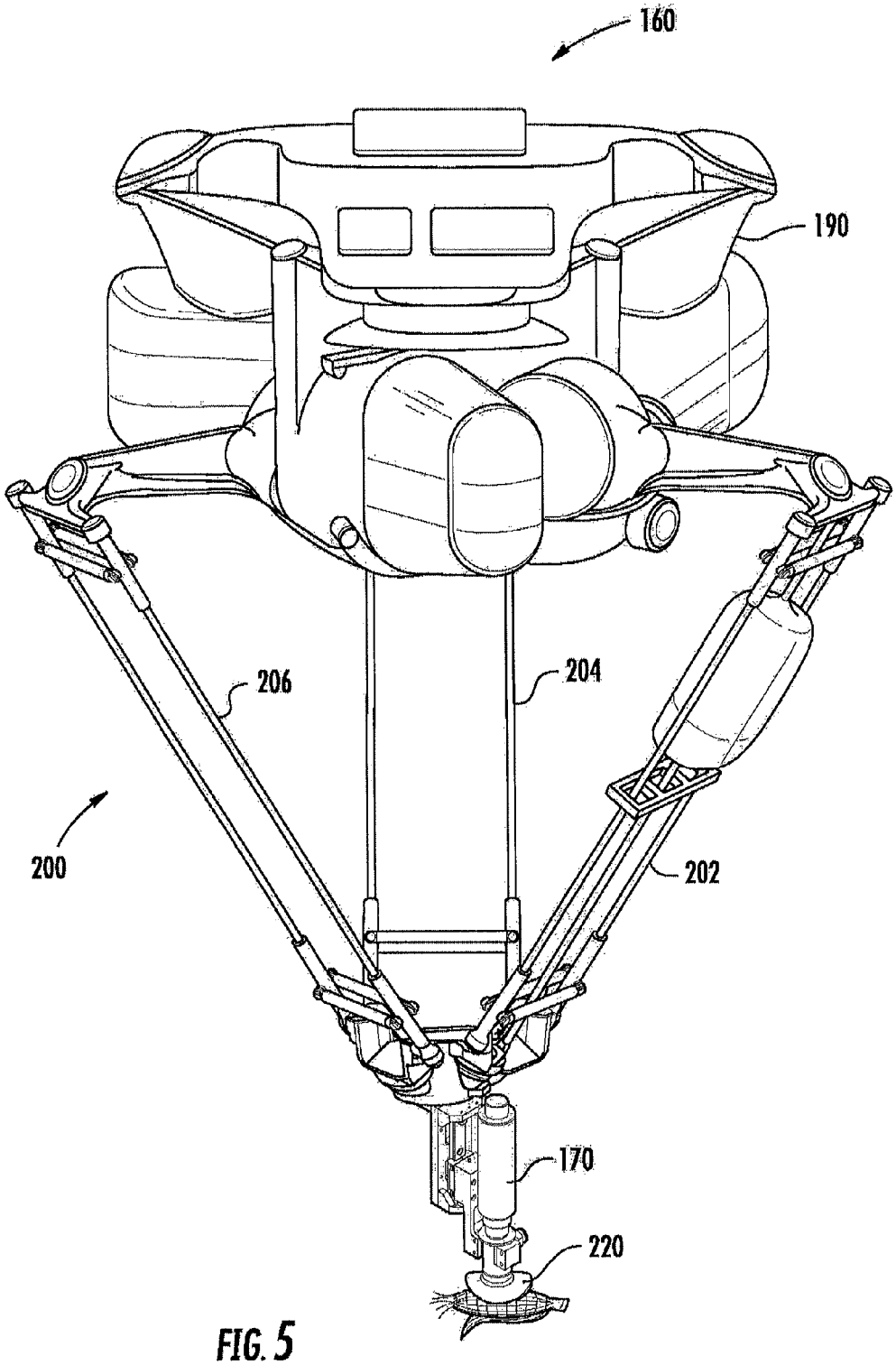
FIG. 5 is a perspective view of the robotic sorter without the conveyor, structural frame, imaging device, or LED's of the optical robotic sorter (shown in FIG. 1).
Figure 6:
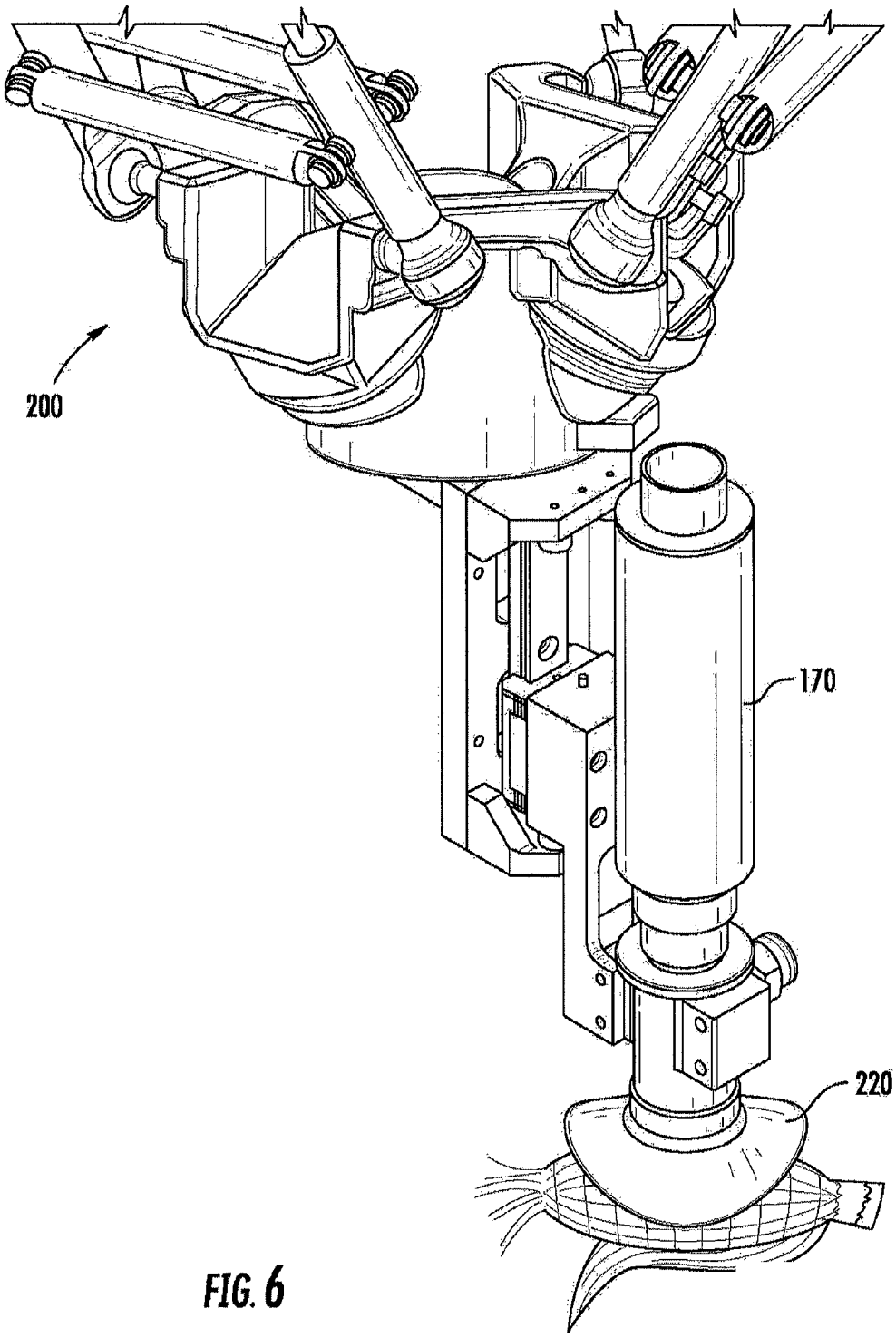
FIG. 6 is an enlarged perspective view of the end-of-arm tool of the robotic sorter.

FIG. 5 is a perspective view of the robotic sorter 160 without the structural frame 180, imaging device 140, or LED's 130, 132 of the optical robotic sorter 100 (shown in FIG. 1). FIG. 5 illustrates the servo housing 190, robotic arm 200, the arm members 202, 204, 206, the end-of-arm tool 170, and the vacuum cup 220 gripping an ear of corn. The servo housing 190 contains motors and other mechanisms necessary to operate the robotic arm 200. The arm members 202, 204, 206 allow the robotic arm 200 to position the end-of-arm tool 170 near product traveling along the conveyor 120 (shown in FIGS. 1-4). In the preferred embodiment, the end-of-arm-tool 170 is telescopic. This allows the end-of-arm-tool 170 to position the vacuum cup 220 against product, such as corn, and ultimately remove the product from the conveyor 120 (shown in FIGS. 1-4). FIG. 5 and FIG. 6 clearly illustrate the vacuum cup 220 wrapping around the product and creating a seal. The suction from the vacuum source 210 allows the robotic sorter 160 to pick up the product, remove the product from its location, and sort the product. In the preferred embodiment, the vacuum cup 220 is made of silicon and is flexible enough to allow the robotic sorter 160 to pick up product even when the vacuum cup 220 is not directly centered against the product. Additionally, the flexibility of the vacuum cup 220 helps to prevent faults from occurring. It is anticipated that the end-of-arm tool 170 or the vacuum cup 220 may have different configurations or may be made out of any material capable of accomplishing their purpose.

The foregoing embodiments provide advantages over currently available processes and devices. In particular the optical robotic sorter 100, the process of sorting product, and the associated features described herein reduce the dependence on human labor and the problems associated with human labor. Additionally, this process and apparatus increases sorting efficiency and accuracy while ultimately reducing the associated costs. The process and apparatus disclosed are able to identify defective product and sort the defective product into multiple sorting areas. Furthermore, defective product may be returned to the beginning of the process or removed from the process.

Although various representative embodiments of this invention have been described above with a certain degree of particularity, those skilled in the art could make numerous alterations to the disclosed embodiments without departing from the spirit or scope of the inventive subject matter set forth in the specification and claims. All directional references, including but not limited to, upper, lower, upward, downward, left, right, top, bottom, above, and below are only used for identification purposes to aid the reader's understanding of the embodiments of the present invention, and do not create limitations, particularly as to the position, orientation, or use of the invention unless specifically set forth in the claims. Joinder references (e.g., attached, coupled, connected) are to be construed broadly and may include intermediate members between a connection of elements and relative movement between elements. As such, joinder references do not necessarily infer that two elements are directly connected and in fixed relation to each other. Additionally, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, and member. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Although the present invention has been described with reference to certain embodiments, persons ordinarily skilled in the art will recognize that changes in detail, form, or structure may be made without departing from the spirit of the invention as defined in the appended claims.

While the foregoing written description enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

What is claimed is:

1. A method of identifying and sorting a product on a conveyor comprising the steps of:

illuminating the product with a light source;

imaging the product using at least one imaging device;

analyzing the image; and activating a means for sorting the product; wherein the sorting means comprises at least one robotic sorter and wherein the robotic sorter comprises a vacuum tool.

2. The method of claim 1, wherein the product is at least one ear of corn.

3. The method of claim 1, wherein the light source comprises a light-emitting diode.

4. The method of claim 3, wherein the light-emitting diode emits a visible light.

5. The method of claim 1, wherein the robotic sorter sorts at a rate of at least 45 picks per minute.

6. The method of claim 1, wherein the robotic sorter sorts at a rate of approximately 90 picks per minute.

* * * * *